US007770656B2

(12) United States Patent
Zupanick

(10) Patent No.: US 7,770,656 B2
(45) Date of Patent: Aug. 10, 2010

(54) SYSTEM AND METHOD FOR DELIVERING A CABLE DOWNHOLE IN A WELL

(75) Inventor: Joseph A. Zupanick, Pineville, WV (US)

(73) Assignee: Pine Tree Gas, LLC, Pineville, WV (US)

( * ) Notice: Subject to any disclaimer, the term of this patent is extended or adjusted under 35 U.S.C. 154(b) by 77 days.

(21) Appl. No.: 12/245,660

(22) Filed: Oct. 3, 2008

(65) Prior Publication Data

US 2009/0090512 A1 Apr. 9, 2009

Related U.S. Application Data

(60) Provisional application No. 60/997,474, filed on Oct. 3, 2007.

(51) Int. Cl.
*E21B 23/08* (2006.01)

(52) U.S. Cl. ..... 166/385; 166/77.1; 166/242.6

(58) Field of Classification Search ..... 166/385, 166/77.1, 153, 242.6
See application file for complete search history.

(56) References Cited

U.S. PATENT DOCUMENTS

| | | | | |
|---|---|---|---|---|
| 202,570 | A | 4/1878 | Wray | |
| 664,628 | A | 12/1900 | Ecaubert | |
| 1,017,847 | A | 2/1912 | Carl | |
| 1,410,827 | A | 3/1922 | Muehl | |
| 1,444,180 | A | 2/1923 | Gartling | |
| 2,329,913 | A | 9/1943 | Kizziar | |
| 2,710,739 | A | 6/1955 | Jourdain | |
| 2,825,411 | A | 3/1958 | Keltner | |
| 3,079,793 | A * | 3/1963 | Le Bus et al. | 73/152.26 |
| 3,459,169 | A | 8/1969 | McNulty | |
| 3,638,732 | A | 2/1972 | Huntsinger et al. | |
| 3,710,877 | A | 1/1973 | Michasiw | |

(Continued)

FOREIGN PATENT DOCUMENTS

CA 2 516 341 A1 1/2007

(Continued)

OTHER PUBLICATIONS

International Search and Written Opinion for International Application No. PCT/US2005/001760 dated Apr. 5, 2005.

(Continued)

*Primary Examiner*—Shane Bomar
(74) *Attorney, Agent, or Firm*—Sonnenschein Nath & Rosenthal LLP

(57) ABSTRACT

A system for delivering a cable through a tubing string to a downhole location in a well, includes a plug and a receiver. The plug includes a first connector configured to be operably connected to the cable and further includes a plug housing adapted to fit within the tubing string. A check valve operably associated with a passage in the plug housing restricts fluid flow through the passage in a downhole direction and allows fluid flow through the passage in an uphole direction. The receiver is configured to be positioned at the downhole location and includes a receiver housing and a second connector configured to be operably connected to a downhole device. The second connector is adapted to communicate with the first connector when the receiver and plug housings are engaged.

31 Claims, 12 Drawing Sheets

U.S. PATENT DOCUMENTS 3,798,966 A * 3/1974 Planche ..... 73/152.02
3,980,369 A 9/1976 Panek
4,074,762 A * 2/1978 Parker et al. ..... 166/385
4,363,168 A 12/1982 Bryer et al.
4,504,199 A 3/1985 Spears
4,552,220 A 11/1985 Jones
4,589,492 A 5/1986 Greiner et al.
4,661,052 A 4/1987 Ruhle
4,767,349 A * 8/1988 Pottier et al. ..... 439/191
4,830,113 A * 5/1989 Geyer ..... 166/369
4,878,540 A 11/1989 Raymond
5,007,852 A * 4/1991 Dean et al. ..... 439/201
5,099,919 A * 3/1992 Schneider et al. ..... 166/188
5,141,051 A * 8/1992 Lenhart ..... 166/65.1
5,285,204 A 2/1994 Sas-Jaworsky
5,392,851 A * 2/1995 Arend ..... 166/65.1
5,518,073 A 5/1996 Manke et al.
5,588,486 A 12/1996 Heinrichs
RE35,454 E 2/1997 Cobb
5,820,416 A 10/1998 Carmichael
5,927,402 A 7/1999 Benson et al.
6,142,237 A 11/2000 Christmas et al.
6,145,590 A 11/2000 Havard
6,280,000 B1 8/2001 Zupanick
6,290,475 B1 9/2001 Snow
6,330,915 B1 12/2001 Moya
6,341,654 B1 * 1/2002 Wilson et al. ..... 166/387
6,357,523 B1 3/2002 Zupanick
6,398,583 B1 6/2002 Zehren
6,412,556 B1 7/2002 Zupanick
6,425,448 B1 7/2002 Zupanick et al.
6,439,320 B2 8/2002 Zupanick
6,454,000 B1 9/2002 Zupanick
6,478,085 B2 11/2002 Zupanick
6,497,281 B2 12/2002 Vann
6,497,556 B2 12/2002 Zupanick et al.
6,510,899 B1 1/2003 Sheiretov et al.
6,561,268 B2 5/2003 Jones
6,561,288 B2 5/2003 Zupanick
6,565,268 B2 5/2003 Nakura et al.
6,575,235 B2 6/2003 Zupanick et al.
6,575,255 B1 6/2003 Rial et al.
6,591,922 B1 7/2003 Rial et al.
6,595,301 B1 7/2003 Diamond et al.
6,595,302 B1 7/2003 Diamond et al.
6,598,686 B1 7/2003 Zupanick
6,604,580 B2 8/2003 Zupanick et al.
6,604,910 B1 8/2003 Zupanick
6,644,422 B1 11/2003 Rial et al.
6,662,870 B1 12/2003 Zupanick
6,668,918 B2 12/2003 Zupanick
6,679,322 B1 1/2004 Zupanick
6,681,855 B2 1/2004 Zupanick et al.
6,688,388 B2 2/2004 Zupanick
6,698,521 B2 3/2004 Schrenkel et al.
6,708,764 B2 3/2004 Zupanick
6,722,452 B1 4/2004 Rial et al.
6,725,922 B2 4/2004 Zupanick
6,732,792 B2 5/2004 Zupanick
6,776,636 B1 8/2004 Cameron et al.
6,848,508 B2 2/2005 Zupanick
6,851,479 B1 2/2005 Zupanick et al.
6,942,030 B2 9/2005 Zupanick
6,945,755 B2 9/2005 Zupanick et al.
6,953,088 B2 10/2005 Rial et al.
6,962,216 B2 11/2005 Zupanick
6,964,298 B2 11/2005 Zupanick
6,964,308 B1 11/2005 Zupanick
6,974,341 B2 12/2005 Jennings
6,976,533 B2 12/2005 Zupanick
6,976,547 B2 12/2005 Rial et al.
6,986,388 B2 1/2006 Zupanick et al.
6,988,548 B2 1/2006 Diamond et al.
6,988,566 B2 1/2006 Zupanick et al.
6,991,047 B2 1/2006 Zupanick
6,991,048 B2 1/2006 Zupanick
7,007,758 B2 3/2006 Zupanick et al.
7,025,137 B2 4/2006 Zupanick
7,025,154 B2 4/2006 Zupanick
7,036,584 B2 5/2006 Zupanick et al.
7,048,049 B2 5/2006 Zupanick
7,073,595 B2 7/2006 Zupanick et al.
7,086,470 B2 8/2006 Diamond et al.
7,090,009 B2 8/2006 Zupanick
7,134,494 B2 11/2006 Zupanick et al.
7,178,611 B2 2/2007 Zupanick
7,182,157 B2 2/2007 Zupanick
7,207,395 B2 4/2007 Zupanick
7,213,644 B1 5/2007 Zupanick
7,216,706 B2 5/2007 Echols et al.
7,219,722 B2 5/2007 Fincher et al.
7,222,670 B2 5/2007 Zupanick
7,225,872 B2 6/2007 Zupanick
7,264,048 B2 9/2007 Zupanick et al.
7,303,007 B2 12/2007 Konschuh et al.
7,311,150 B2 12/2007 Zupanick
7,353,877 B2 4/2008 Zupanick
7,360,595 B2 4/2008 Zupanick et al.
7,434,620 B1 10/2008 Zupanick
7,607,477 B2 * 10/2009 Stoesz et al. ..... 166/242.6
2002/0050361 A1 5/2002 Shaw et al.
2003/0196815 A1 10/2003 Crawford et al.
2004/0040749 A1 3/2004 Terry et al.
2006/0048934 A1 3/2006 Charabin
2006/0243450 A1 11/2006 Head
2008/0078556 A1 * 4/2008 Stoesz et al. ..... 166/378
2008/0210441 A1 * 9/2008 Scott et al. ..... 166/385
2008/0264651 A1 * 10/2008 Ali et al. ..... 166/385
2009/0090517 A1 * 4/2009 Jackson et al. ..... 166/385

FOREIGN PATENT DOCUMENTS

RU 2 249 726 C2 4/2005
WO WO 00/58602 10/2000

OTHER PUBLICATIONS

International Search Report and Written Opinion dated Apr. 8, 2009 for International Patent Application No. PCT/US08/13485.

* cited by examiner

SYSTEM AND METHOD FOR DELIVERING A CABLE DOWNHOLE IN A WELL

CROSS-REFERENCE TO RELATED APPLICATIONS

This application claims the benefit of U.S. Provisional Application No. 60/997,474, filed Oct. 3, 2007, which is hereby incorporated by reference.

BACKGROUND

1. Field of the Invention

The invention relates generally to the recovery of subterranean deposits and more specifically to methods and systems for removing produced fluids from a well.

2. Description of Related Art

Horizontal coalbed methane wells are particularly susceptible to production problems caused by the presence and accumulation of solid particles in the wellbore. For example, during the life of a horizontal coalbed methane well, many tons of small coal particles, termed coal "fines", can be co-produced along with the methane and water. In the early stages of the well, these solid particles typically pose little problem for the production process. High flow rates of both water and gas create enough velocity within the wellbore to keep the solids entrained in the production fluids and moving towards the pumping equipment installed in the well. At the pump inlet, again, the solids stay entrained in the liquid phase and are pumped from the well.

In the later stages of the life of a coalbed methane well, coal fines may begin to pose a problem. Gas flow alone may not be able to carry solids along the wellbore, resulting in those solids being left to settle in the low angle undulations of the wellbore. The solids may ultimately form a restriction to the flow of gas, and a resulting drop in production may occur. Alternatively, the settling of these solids near the pump inlet may block the inlet to the pump, thereby reducing the ability of the pump to remove water from the wellbore.

Borehole stability issues may also contribute to production problems of a well. In some cases, the wellbore can collapse and deposit large, medium and small pieces of coal in the wellbore. The cubical-shaped pieces of coal can easily form a bridge within the wellbore and restrict the flow of wellbore fluids. This restriction may cause further settling of entrained solids.

Referring to FIG. 1, a well 100 includes a wellbore 105 having a substantially vertical portion 110 and a substantially horizontal portion 115. The wellbore 105 extends from a surface 120 to a formation 123 located beneath the surface 120. A pump 125 is positioned downhole within the substantially horizontal portion 115 and is electrically connected by a transmission cable 126 to a power supply 128 positioned at the surface 120. The pump 125 is provided to remove liquids 127 (e.g. water) that are produced by the formation 123. The liquids are pumped through a tubing string 130 to a reservoir 133 at the surface 120. To illustrate an example mentioned previously, well 100 may be a coalbed methane well that is drilled into a coal formation. Deposits 135 of solid particles (e.g. coal) may accumulate within the wellbore, which could block the inlet to pump 125.

One method that has been used to overcome the problem of solids settling in the well includes injecting additional fluids, either water or gas, at some point in the well, thereby increasing fluid flow velocity. The increase in flowing velocity, however, carries a penalty in the form of additional pressure against the producing formation. Further, the production facilities must handle the additional volumes of injected fluids. Another system for clearing a wellbore uses a longitudinal movement of an agitating device in a borehole. This system may be effective at agitation, however, a sudden build-up of solids may cause the device to become lodged and render the entire mechanism unusable. Both of these systems have inefficiencies and problems that are solved by the systems and methods of the embodiments described herein.

The removal water accumulated solids from a well presents other problems related to the use of downhole pumps. Installation and removal of the pumps is complicated by having to deal with the pump cable that powers the pump motor. During pump installation, the power cable is first spliced onto the leads of the motor. The cable is then attached to the discharge tubing as the pump is lowered into the well. Various methods are used to attach the cable to the tubing, including clamps, adhesives, and specially manufactured attachment devices.

When the pump is being installed in the well, the pump cable is subjected to a risk of damage due to abrasion and crushing. The risks are significantly increased when the pump is run through a deviated section of the well. Frequently, a flat, steel-armored cable is used to mitigate these risks; however, this special cable is expensive and still only provides an incremental level of reduced risk.

SUMMARY

The problems presented by existing methods for delivering power downhole are solved by the systems and methods of the illustrative embodiments described herein. In one embodiment, a system for providing power to a downhole location in a well is provided. The system includes a pump positioned in the well and a tubing string in fluid communication with the pump to receive liquid discharged from the pump. The system further includes an electrical cable in communication with an electrical power source, a plug and a receiver. The plug includes at least one conductor in electrical communication with the electrical cable and further includes a plug housing adapted to fit within the tubing string. The plug housing includes a passage to permit fluid flow past the plug housing, and a check valve is operably associated with the passage of the plug housing. The check valve restricts fluid flow through the passage in a downhole direction and allows fluid flow through the passage in an uphole direction. The receiver is positioned at the downhole location and includes a receiver housing and at least one conductor in electrical communication with the pump. The at least one conductor of the receiver is adapted to electrically communicate with the at least one conductor of the plug when the receiver housing and the plug housing are engaged. The receiver housing further includes a passage in fluid communication with the tubing string and the pump.

In another embodiment, a system for delivering a cable through a tubing string to a downhole location in a well includes a plug and a receiver. The plug includes a first connector configured to be operably connected to the cable and a plug housing adapted to fit within the tubing string. The plug housing has a passage that permits fluid flow past the plug housing. A check valve is operably associated with the passage of the plug housing to restrict fluid flow through the passage in a downhole direction and allow fluid flow through the passage in an uphole direction. The receiver is configured to be positioned at the downhole location and includes a receiver housing and a second connector configured to be operably connected to a downhole device. The second connector of the receiver is adapted to communicate with the first connector of the plug when the receiver housing and the plug housing are engaged.

In still another embodiment, a method for delivering a cable through a tubing string to a downhole location in a well is provided. The method includes providing a receiver at the downhole location, the receiver having a conductor in communication with a downhole device. A fluid is introduced into the tubing string at a surface of the well, and a plug is positioned in the tubing string. The plug includes a conductor in communication with a cable. The method further includes delivering the plug to the downhole location by pumping fluid into the tubing string uphole of the plug. The plug and the receiver are engaged such that the conductor of the plug communicates with the conductor of the receiver. Power is delivered from a surface of the well to the downhole device through the cable.

Other objects, features, and advantages of the invention will become apparent with reference to the drawings, detailed description, and claims that follow.

DETAILED DESCRIPTION OF ILLUSTRATIVE EMBODIMENTS

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

The embodiments of the invention described herein are directed to improved systems and methods for maintaining a wellbore free of obstructions caused by solids, which is accomplished at least in part by the agitation of those solids through axial rotation of a member within the wellbore. The rotated member preferably includes an offset portion in which a longitudinal axis of the rotated member is offset from an axis about which the rotated member is rotated. In one embodiment, the rotated member may be a specially configured tubing string that is positioned within a horizontal portion of a well. The tubing string may be pre-formed with a helical spiral such that the rotation of the tubing string would cause the tubing string to "wipe" the circumference of the wellbore along the entire length of the tubing string. The "direction" of the helix is such that rotation preferably moves solids toward an extraction point in the wellbore. In addition to the agitation of solids, this rotating action of the tubing string is capable of continuously providing an open wellbore path for the flow of wellbore fluids. In one embodiment, the tubing string is formed from steel tubing. Due to the flexible nature of the steel tubing string, if the wellbore suddenly collapses or becomes blocked, the tubing string is still able to rotate. As the tubing rotates through the blockage, over time, the tubing string expands to the original helically-shaped configuration and swept diameter, thereby allowing wellbore fluids to continue to flow.

The term "tubing string" is not meant to be limiting and may refer to a single component or a plurality of hollow or solid sections formed from tubing or pipe. The tubing string may have a substantially circular cross-section, or may include cross-sections of any other shape.

Figure 1:
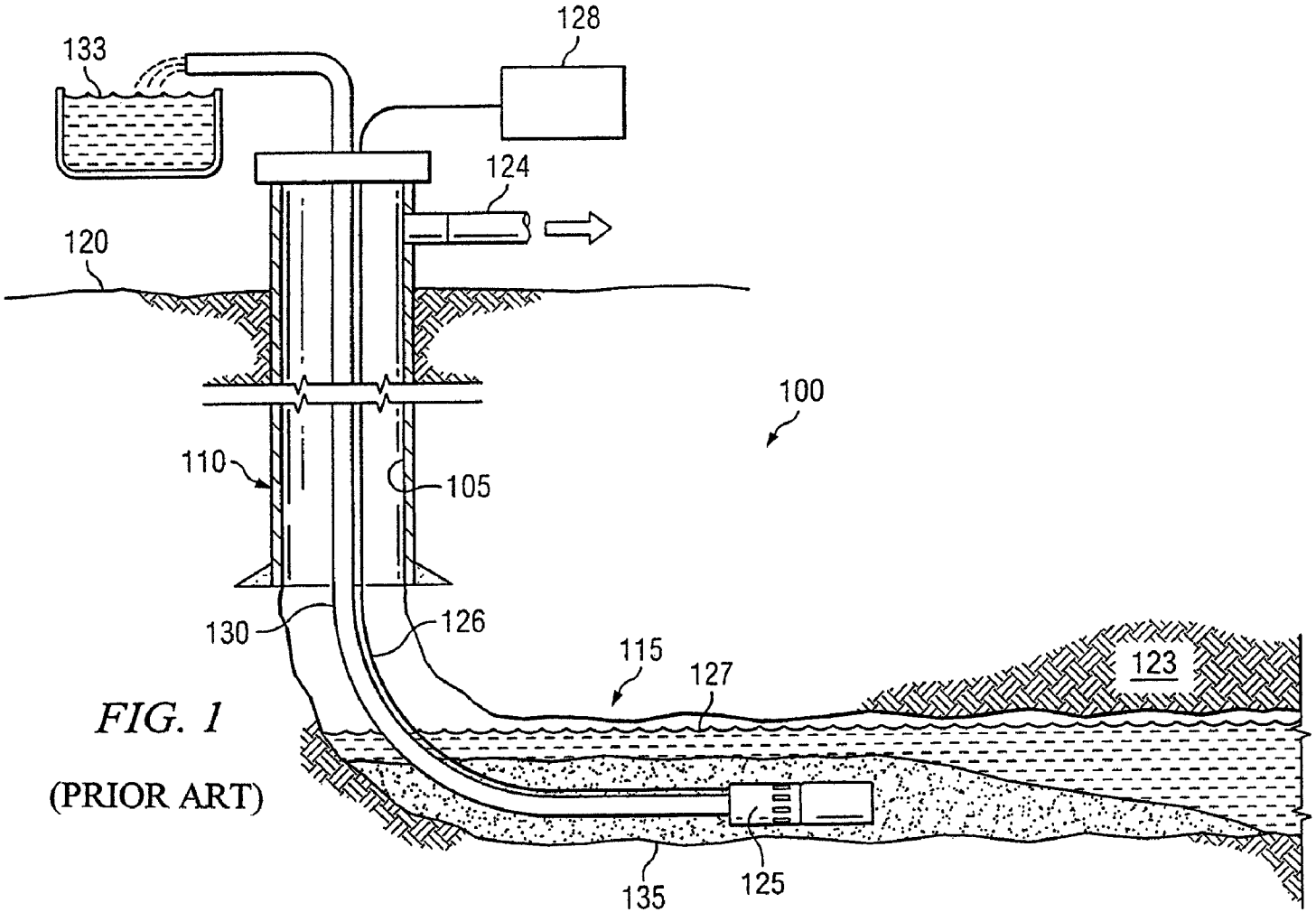
FIG. 1 (PRIOR ART)
FIG. 1 illustrates a well having a substantially horizontal portion in which liquid and solid deposits have accumulated.
Figure 2:
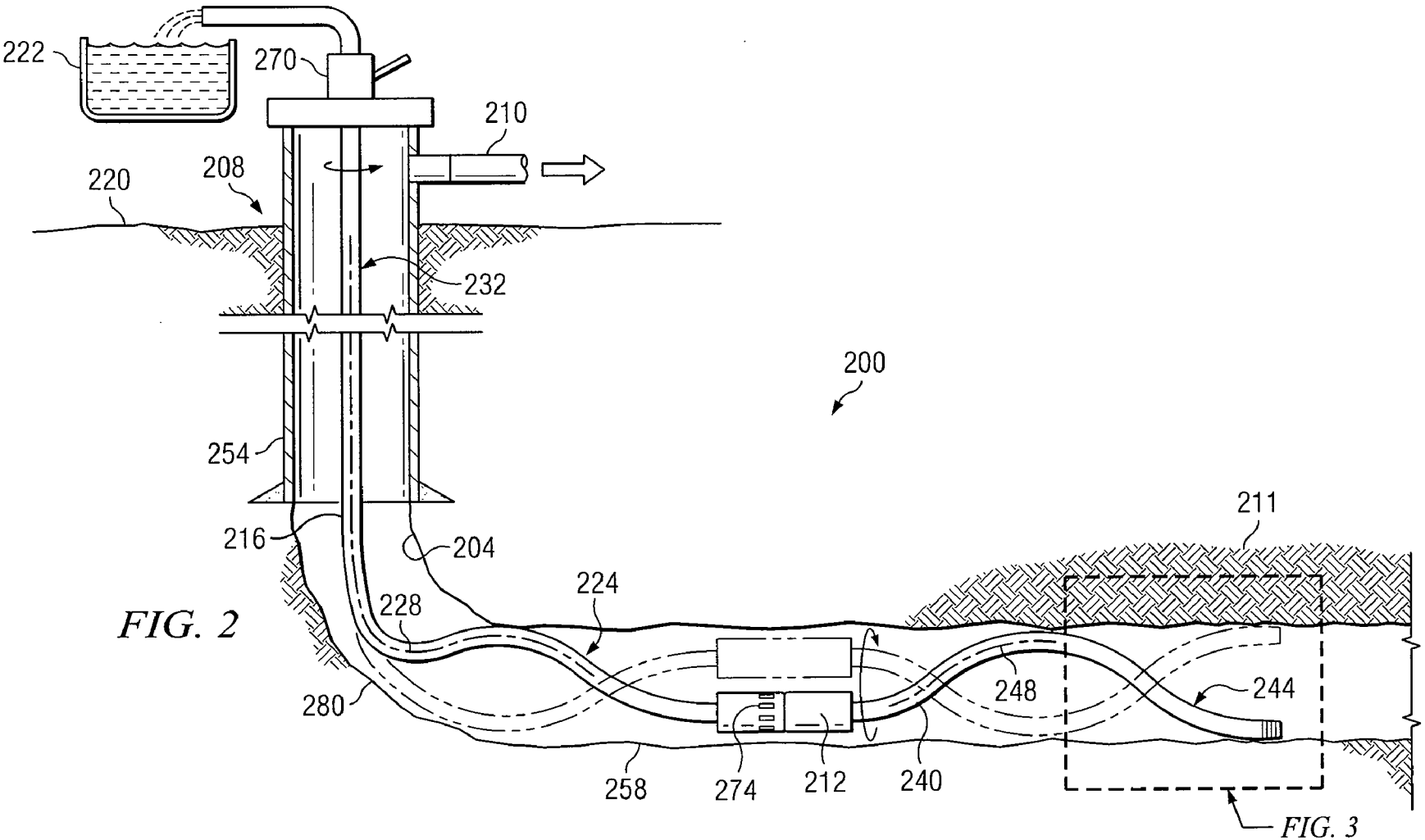
FIG. 2. depicts a system for controlling solids in a wellbore of a well according to an illustrative embodiment of the invention.
Figure 3:
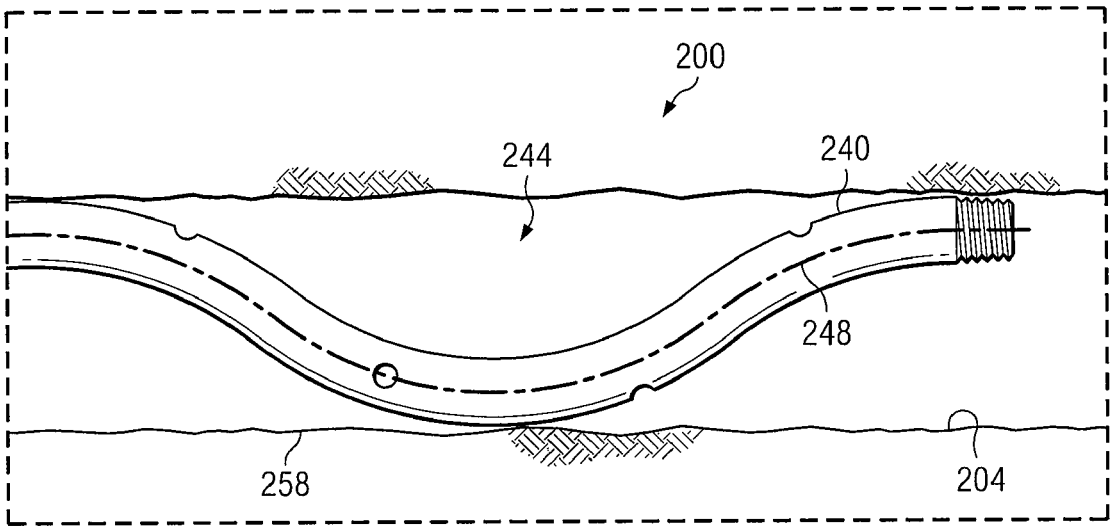
FIG. 3 illustrates a detailed view of an offset portion of a tubing string of the system of FIG. 2.

Referring to FIGS. 2 and 3, a system 200 for controlling solids within a wellbore 204 of a well 208 according to an illustrative embodiment includes a pump 212 positioned downhole. A first tubing string 216 extends from a surface 220 of the well 208 and is operatively connected to the pump 212. In one embodiment, the first tubing string 216 includes an offset portion 224 in which a longitudinal axis 228 of the first tubing string 216 is offset from an axis of rotation about which the first tubing string 216 is capable of being rotated. The axis of rotation of the first tubing string 216 in a non-offset portion 232 of the first tubing string 216 substantially corresponds to the longitudinal axis 228 of the first tubing string 216 in the non-offset portion 232. In one embodiment, the axis of rotation in the offset portion 224 substantially corresponds to a longitudinal axis of the wellbore 204.

A second tubing string 240 is operatively connected to the pump 212 and extends downhole from the pump 212. In one embodiment, the second tubing string 240 includes an offset portion 244 in which a longitudinal axis 248 of the second tubing string 240 is offset from an axis of rotation about which the second tubing string 240 is capable of being rotated. In one embodiment, the axis of rotation of the second tubing string 240 in the offset portion 244 substantially corresponds to a longitudinal axis of the wellbore 204.

The wellbore 204 may include a substantially vertical portion 254 and a substantially horizontal portion 258. The offset portions 224 of the first tubing string 216 and the offset portion 244 of the second tubing string 240 are preferably positioned substantially within the substantially horizontal portion 258 of the wellbore 204. The rotation of these offset portions 224, 244 by a rotator 270 positioned at the surface 220 allows the offset portions 224, 244 to "wipe" the circumference of the wellbore 204 and agitate solids that have settled within the substantially horizontal portion 258 of the wellbore 204. This agitation of the solids assists in keeping the solids entrained within any accumulated liquid in the wellbore, which prevents solids from blocking an inlet 274 to the pump 212. While the rotation of the first and second tubing strings 216, 240 in one embodiment may be continuous to prevent solids from settling in the wellbore 204, in another embodiment, the first and second tubing strings 216, 240 may only be operated intermittently such that solids are allowed to settle within the wellbore 204 between operations of the pump 212. While the wiping operation has been described with reference to the substantially horizontal portion 258 of the wellbore 204, it will be recognized that the offset portions 224, 244 of the first and second tubing strings 216, 240 may be positioned and operated in other portions of the wellbore 204, including without limitation the substantially vertical portion 244 or along a curve 280 of the wellbore 204. Similarly, it is possible that the offset portions 224, 244 of the first and second tubing strings 216, 240 may be positioned and operated along cased or uncased lengths of the wellbore 204.

In one embodiment, the offset portions 224, 244 of the first and second tubing strings 216, 240 may be pre-formed with a helical spiral. The outer swept diameter of the helical spiral may be any dimension, up to and including the wellbore diameter. In one embodiment, the offset portions 224, 244 of the tubing strings 216, 240 may be placed adjacent to, or near the pump 212. Depending on the application, the offset portions may be provided on a discharge side, a suction side, or both sides of the pump 212. If the offset portions are helically-shaped, the helical spiral may be left handed or right handed. Preferably, the direction of the helical spiral for a particular offset portion of a tubing string is correctly paired with the direction of rotation of the tubing string to provide an auger action that sweeps solids toward the inlet 274 of the pump 212.

In another embodiment, the offset portions 224, 244 may be wave-shaped such that each longitudinal axis of the offset portions is substantially planar. In either a wave-shaped or helical configuration, each offset portion includes a longitudinal axis that is substantially non-linear and that may vary substantially from an axis about which the offset portion is capable of rotating.

As illustrated in FIG. 2, rotation of the first and second tubing strings 216, 240 also results in a rotational movement of the pump 212 within the wellbore. When rotation of the first and second tubing strings 216, 240 is halted, it is possible that the pump 212 lands at one of many different locations in the wellbore 204. In many cases, it is preferred that the pump 212 be positioned at a lower position in the substantially horizontal portion 258 (shown in solid lines) as opposed to a higher position (shown in phantom lines) since positioning the pump 212 lower in the wellbore 204 allows the removal of more liquid.

Figure 4:
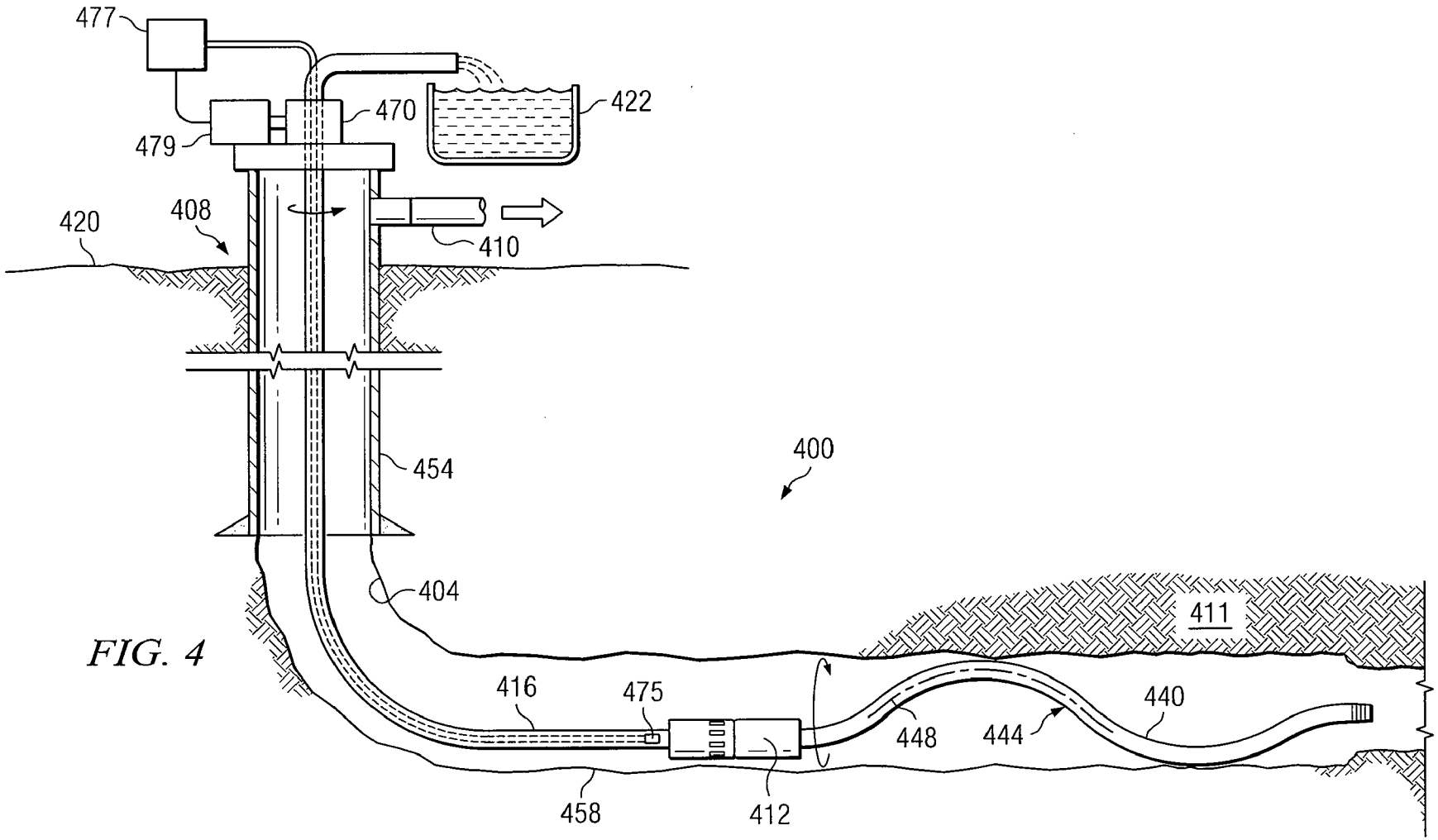
FIG. 4 depicts a system for controlling solids in a wellbore of a well according to an illustrative embodiment.

Referring to FIG. 4, a system 400 for controlling solids within a wellbore 404 of a well 408 according to an illustrative embodiment includes a pump 412 positioned downhole. A first tubing string 416 extends from a surface 420 of the well 408 and is operatively connected to the pump 412. In the embodiment illustrated in FIG. 4, first tubing string 416 contains no offset portion.

A second tubing string 440 is operatively connected to the pump 412 and extends downhole from the pump 412. In one embodiment, the second tubing string 440 includes an offset portion 444 in which a longitudinal axis 448 of the second tubing string 440 is offset from an axis of rotation about which the second tubing string 440 is capable of being rotated. The axis of rotation of the second tubing string 440 in the offset portion 444 substantially corresponds to a longitudinal axis of the wellbore 404.

Similar to well 208 of FIGS. 2 and 3, the wellbore 404 may include a substantially vertical portion 454 and a substantially horizontal portion 458. The pump 412 and the offset portion 444 of the second tubing string 440 are preferably positioned substantially within the substantially horizontal portion 458 of the wellbore 404. The wiping action of the offset portion 444 is similar to that described with reference to FIGS. 2 and 3, and the first and second tubing strings are rotated by a rotator 470 positioned at the surface 420.

In one embodiment, only a brief and intermittent rotation of the offset portion 444 of the second tubing string 440 between pumping cycles is anticipated. Since the pump 412 may be adjacent to or near the offset portion 444, the pump 412 is subject to the same positioning issues previously described. When the rotation of the first and second tubing strings 416, 440 is stopped, it is possible that the pump 412 lands at one of many different locations in the wellbore 404. In many cases, it is preferred that the pump 212 be positioned at a lower position (shown in FIG. 4) in the substantially horizontal portion 458 as opposed to a higher position since positioning the pump 412 lower in the wellbore 404 allows the removal of more liquid. An inclinometer 475 may be operatively associated with the first tubing string 416 or the pump 412 to provide an indication of the location of the pump within its circular path about the wellbore circumference. The inclinometer 475 may be electrically connected to a control system 477 at the surface 420 or dowhnole that communicates with a motor 479 that is capable of turning the rotator 470 to selectively position the pump 412 in the wellbore 404.

Figure 5:
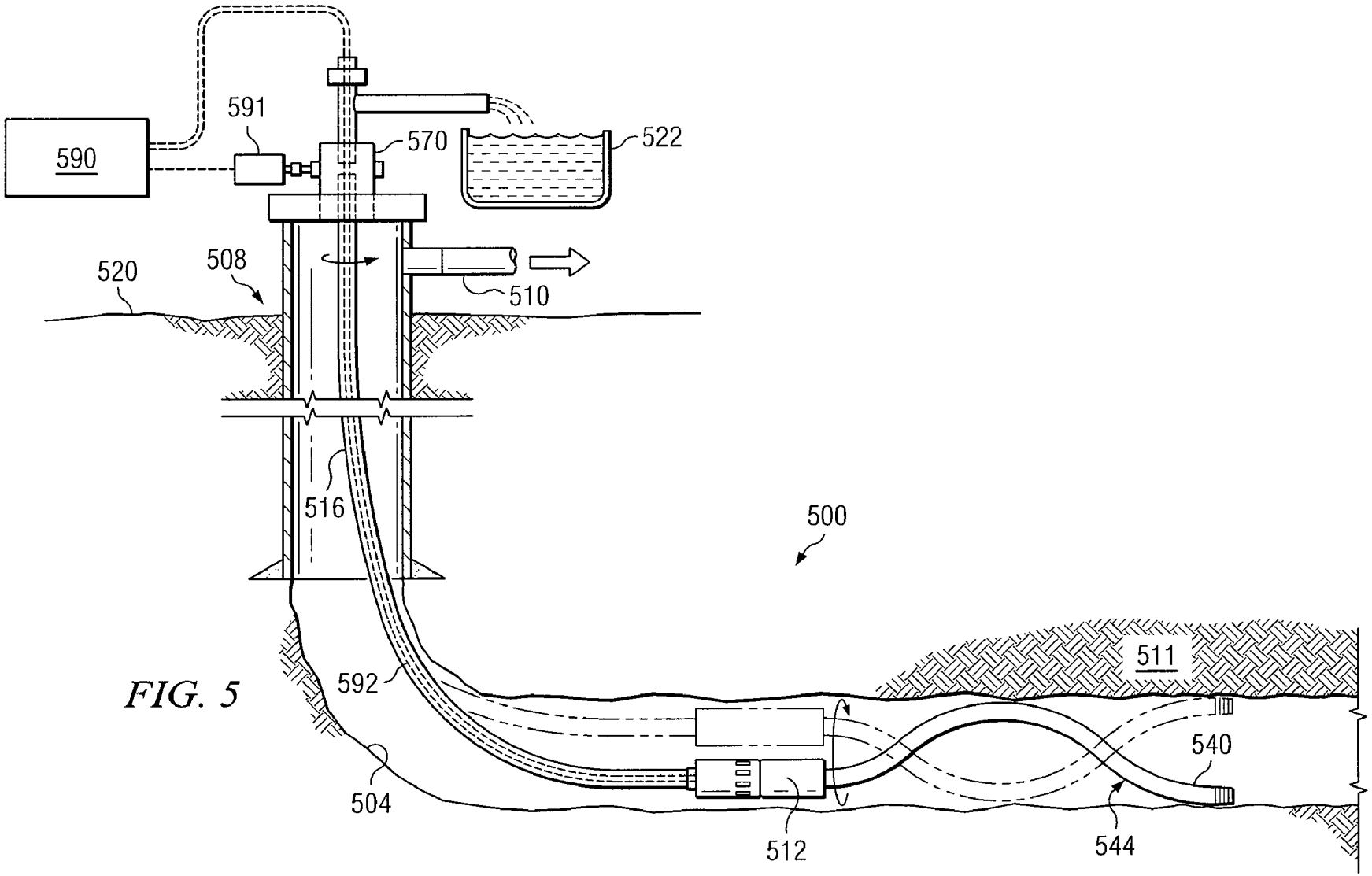
FIG. 5 illustrates a system for controlling solids in a wellbore of a well according to an illustrative embodiment, the system having an electric submersible pump in communication with a control unit via a communication line.

Referring to FIG. 5, a system 500 for controlling solids within a wellbore 504 of a well 508 according to an illustrative embodiment includes a pump 512 positioned downhole. A first tubing string 516 extends from a surface 520 of the well 508 and is operatively connected to the pump 512. A second tubing string 540 is operatively connected to the pump 512 and includes an offset portion 544 similar to those offset portions described previously.

Pump 512 is an electrically submersible pump. A rotator 570 is positioned at the surface 520 to turn the first and second tubing strings 516, 540 and the pump 512. A control unit 590 having a timer communicates with a motor 591 that is operatively connected to the rotator 570. The control unit 590 also communicates with the pump 512 via a pump cable 592 or other communication line. While the pump cable 592 could be positioned outside of the first tubing string 516, in the embodiment illustrated in FIG. 5, the pump cable 592 is positioned within the first tubing string 516 to protect the pump cable 592 from abrasion and damage. The pump cable 592 may be delivered downhole using a system and method similar to that described below.

Referring to FIGS. 6A-6E, a cable delivery system 608 according to an illustrative embodiment is provided for delivering a cable 612 to a downhole device positioned at a downhole location 614 in a well bore 616 of a well 618. In the embodiment illustrated in FIGS. 6A-6E, the downhole device is a pump 620 and the cable 612 is an electric cable for providing power to the pump 620. The delivery of the cable 612 occurs after the pump 620 has been run into the well 616 at an end of a tubing string 624 fluidly connected to the pump 620. After installation of the tubing string 624 and pump 620, the cable 612 is installed as explained in more detail below within the tubing string 624. The pump installation and removal process is greatly simplified by delivering the cable 612 in this manner since the time-consuming process of simultaneously handling the tubing and the cable 612 is eliminated. Additionally, by installing the cable 612 within the tubing string 624, the cable 612 is protected from the damage.

Figure 6A:
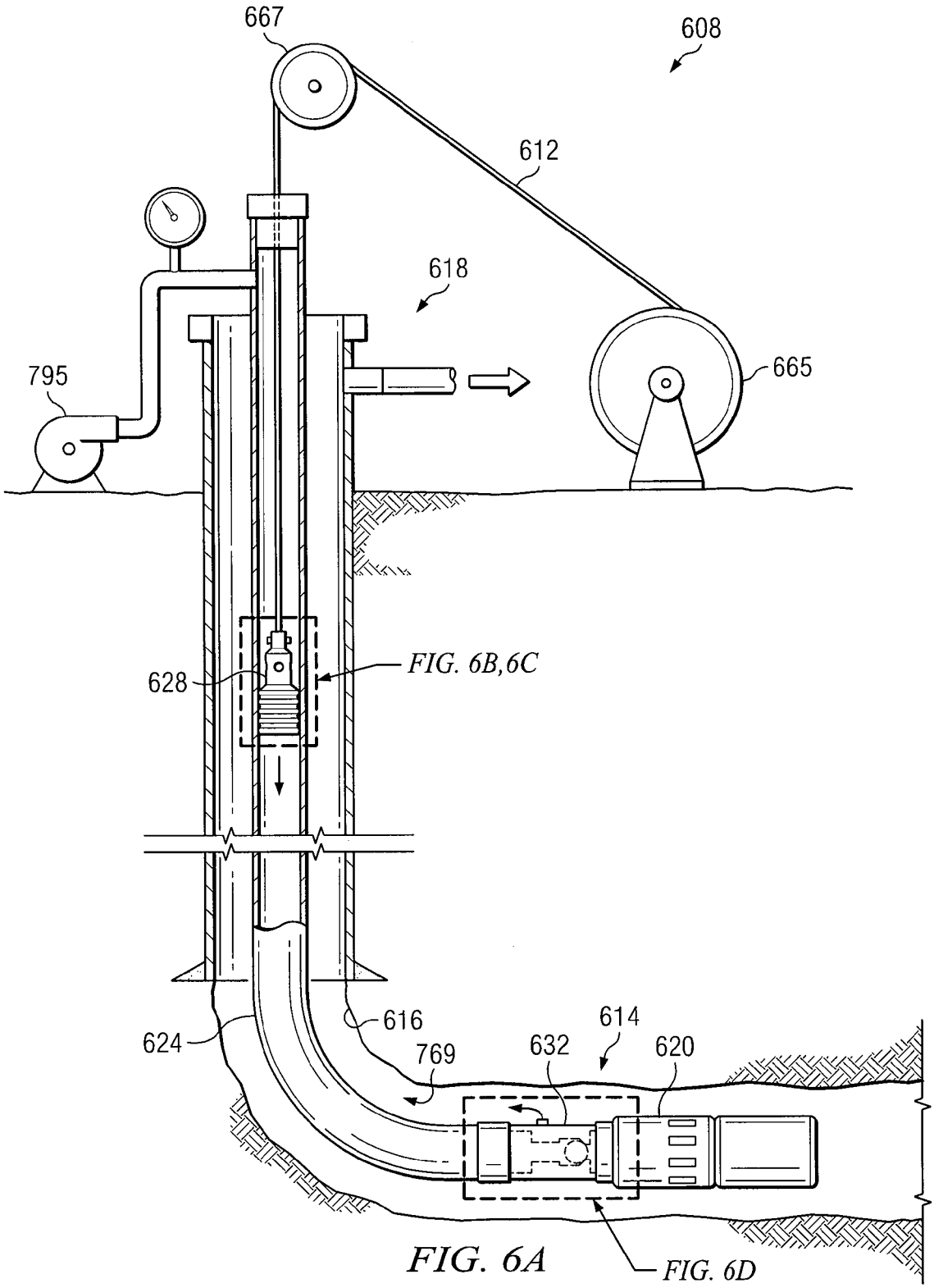
FIG. 6A depicts a system for delivering a cable to a downhole location, the system including a plug and a receiver according to an illustrative embodiment.
Figure 6B:
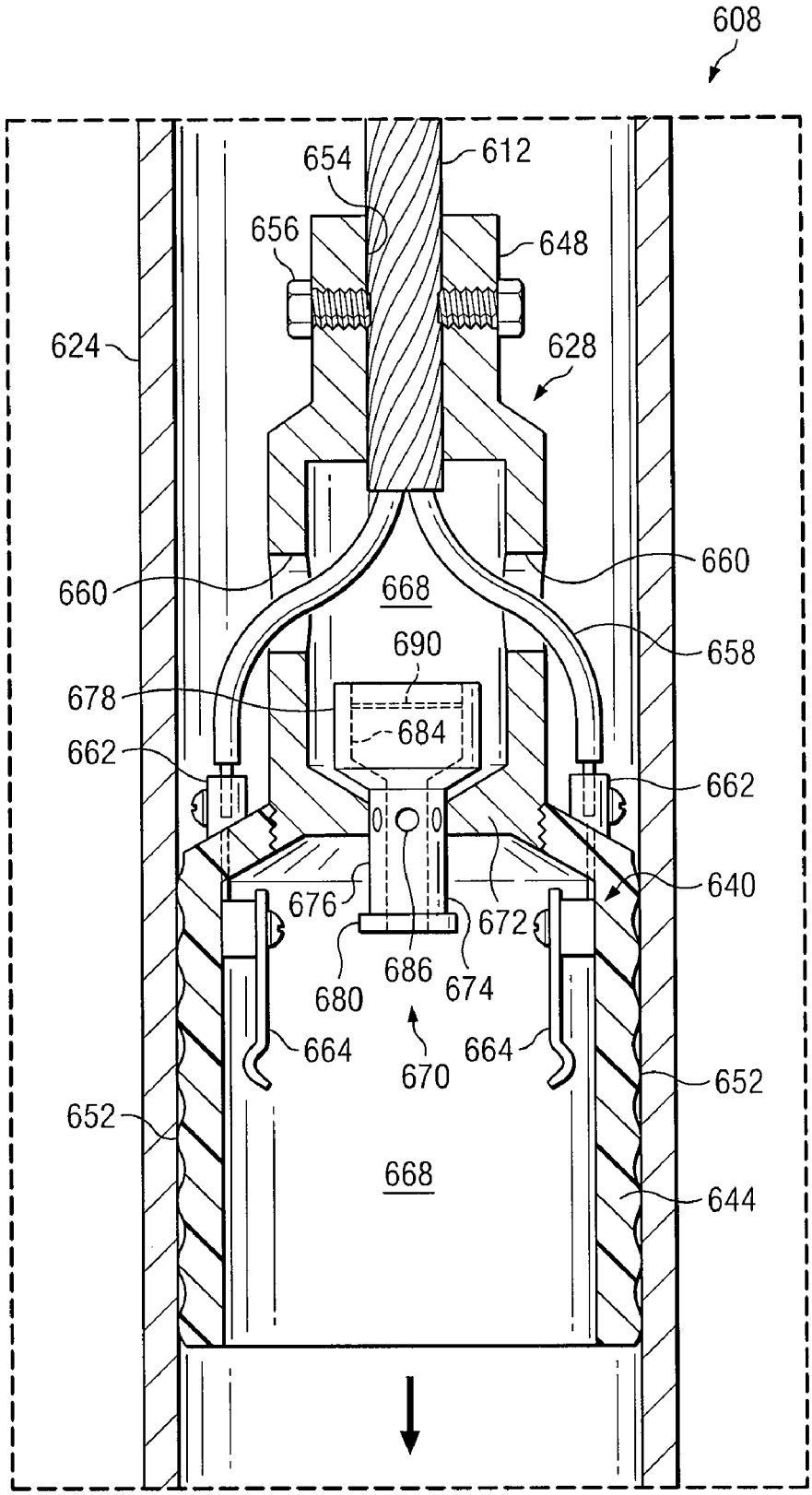
FIG. 6B illustrates the plug of the system of FIG. 6A according to an illustrative embodiment.

The cable delivery system 608 includes a plug 628 and a receiver 632. Referring more specifically to FIG. 6B, the plug 628 includes a plug housing 640 adapted to fit within the tubing string 624 such that the plug 628 is cable of moving longitudinally within the tubing string 624. The plug housing 640 includes a guide member 644 connected to a strain relief member 648. The guide member 644 may be substantially cylindrical in shape and closely matched in size to an interior diameter of the tubing string 624. An exterior surface of the guide member 644 may be composed of an elastomeric material and may include corrugations, undulations, or an otherwise irregular surface to provide contact points 652 with the tubing string 624. The multiple contact points 652 ensure that plug housing 640 is adequately capable of restricting fluid flow past the plug housing 640 but minimize the surface area contacting the tubing string 624, which improves the ability of the plug housing 640 to slide within the tubing string 624.

The strain relief member 648 includes a cable passage 654 for receiving the cable 612. One or more bolts 656, screws, or other fastening means may be employed to secure the cable 612 to the strain relief member 648. In the embodiment shown in FIG. 6B, the cable 612 is a duplex cable and includes a pair of individually insulated electrical lines 658. The electrical lines 658 each pass through a discharge port 660 and are secured to wire terminals 662. Each wire terminal 662 is electrically connected to a conductor 664. The plug 628 includes a passage 668 to permit fluid flow past the plug housing 640. The passage 668 extends through both the guide member 644 and the strain relief member 648. A valve 670, such as a one-way or check valve, is operably associated with the passage 668 to restrict fluid flow through the passage 668 in a downhole direction and allow fluid flow through the passage 668 in an uphole direction. The valve 670 includes a valve seat 672 and a valve body 674. The valve body includes a central region 676, an upper shoulder region 678, and a lower shoulder region 680. The central region 676 may be substantially cylindrical and slidingly received by the valve seat 672. A valve passage 684 passes through the upper shoulder region 678, central region 676, and lower shoulder region 680 of the valve body 674. A plurality of ports 686 are disposed in the central region 676 to communicate with the valve passage 684.

The longitudinal travel of the valve body 674 within the valve seat 672 is limited by the upper shoulder region 678 and the lower shoulder region 680. The valve body 674 is capable of sliding within the valve seat 672 between an open position (not illustrated) and a closed position (see FIG. 6B). The closed position is achieved by the presence of fluid uphole of the plug 628 having a pressure higher than that of fluid downhole of the plug 628. In the closed position, the plurality of ports 686 are aligned with the valve seat 672, which prevents fluid uphole of the plug 628 from flowing through passage 668 and valve passage 684.

In order to facilitate removal of the cable 612 and plug 628 from the well, a pressure relief device 690 is positioned within the valve passage 684 in the upper shoulder region 678 of the valve body 674. In the embodiment illustrated in FIG. 6B, the pressure relief device 690 is a rupture disk configured to fail at a pre-determined differential pressure. When the pressure of fluid uphole of the plug 628 is less than a set pressure of the pressure relief device 690, fluid flow through the valve passage 684 in the vicinity of the upper shoulder region 678 is prevented. Under these circumstances fluid flow through the valve passage 684 may only occur if the valve body 674 moves into the open position. However, when the pressure of fluid uphole of the plug 628 exceeds the set pressure of the pressure relief device 690, the rupture disk will rupture, thereby permitting fluid to flow through the valve passage 684 even though the valve body 674 may be in the closed position.

It is important to note that the pressure relief device 690 may be a more traditional relief valve that is capable of repeated use. The relief valve may be operably associated with either the valve body 674 or the plug housing 640 to permit fluid flow through the passage 668 when the pressure of fluid uphole of the plug 628 is equal to or exceeds the set pressure of the relief valve.

Figure 6C:
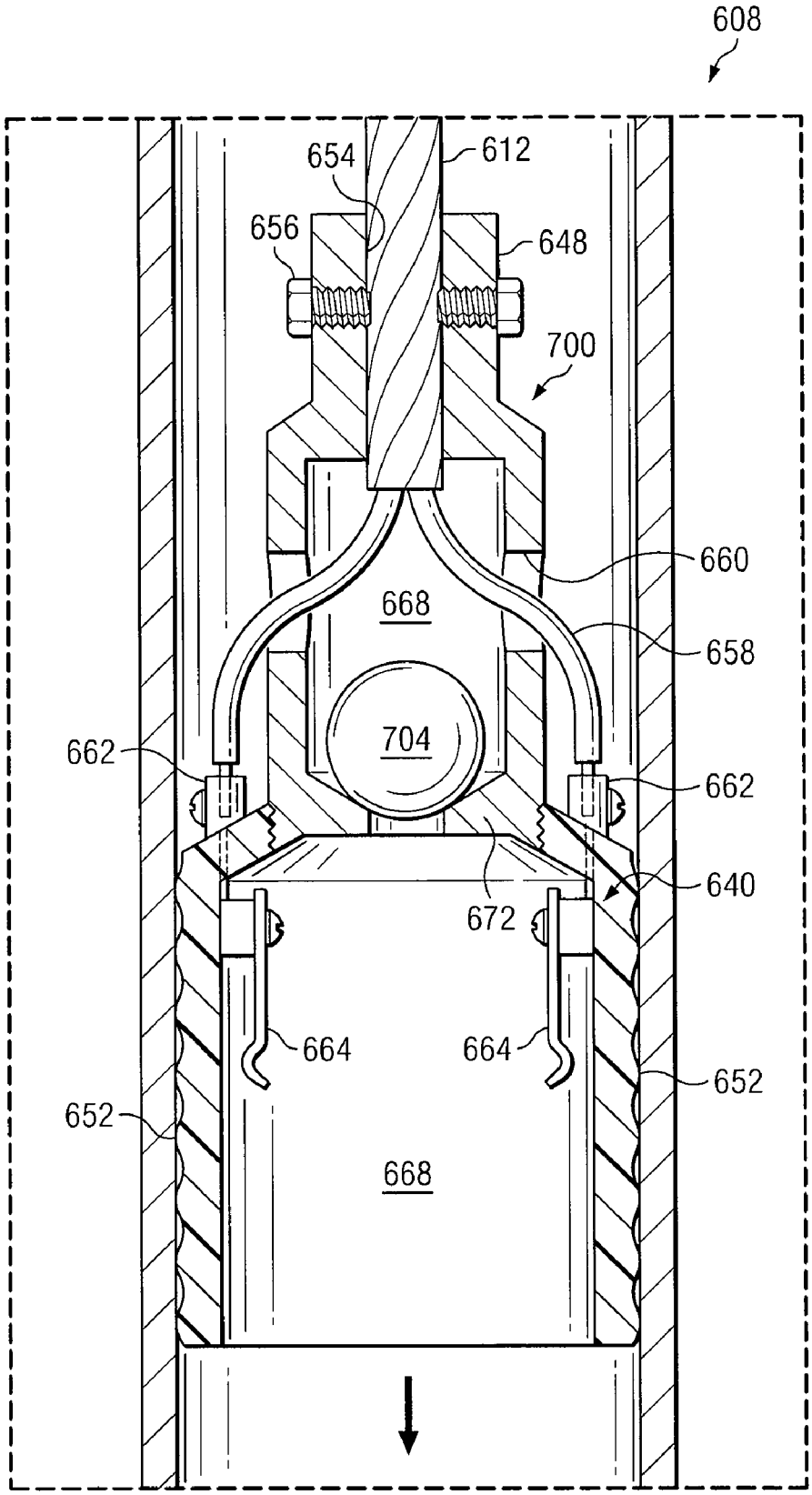
FIG. 6C depicts an alternative plug of the system of FIG. 6A according to an illustrative embodiment.

Referring more specifically to FIG. 6C, another embodiment of a plug 700 is illustrated, which includes similar components to those discussed with reference to plug 628. Identical reference numerals to those illustrated in FIG. 6B are used to illustrate similar components. The primary difference between plug 700 and plug 628 is that plug 700 includes a ball 704 and valve seat 672 arrangement. Fluid flow through the passage 668 is controlled by the ball 704 moving into or out of contact with the valve seat 672. An additional difference related to plug 700 is the absence of a pressure relief device; however, it should be noted that a relief valve similar to that described above could be associated with plug housing 640.

Figure 6D:
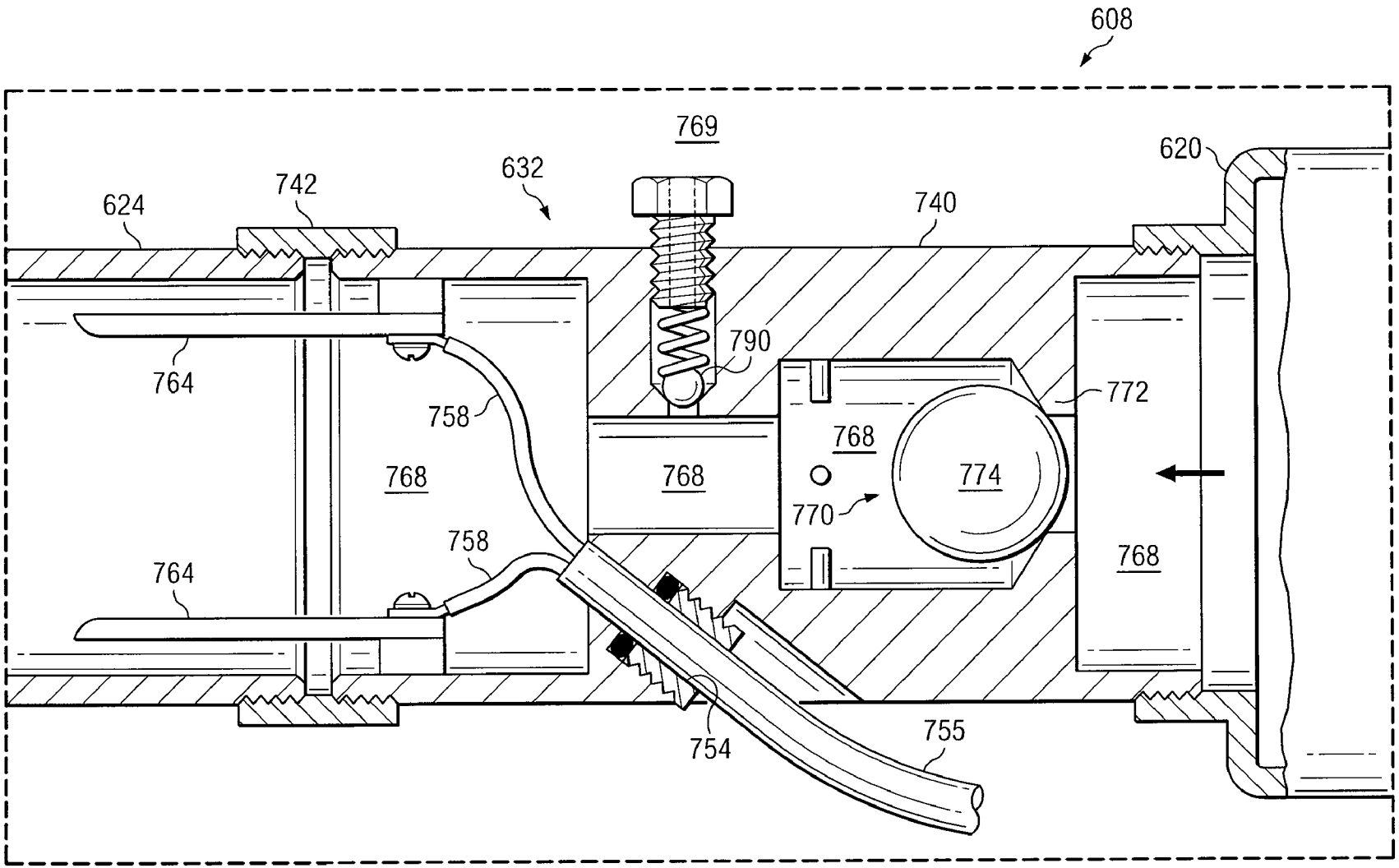
FIG. 6D illustrates the receiver of the system of FIG. 6A.
Figure 6E:
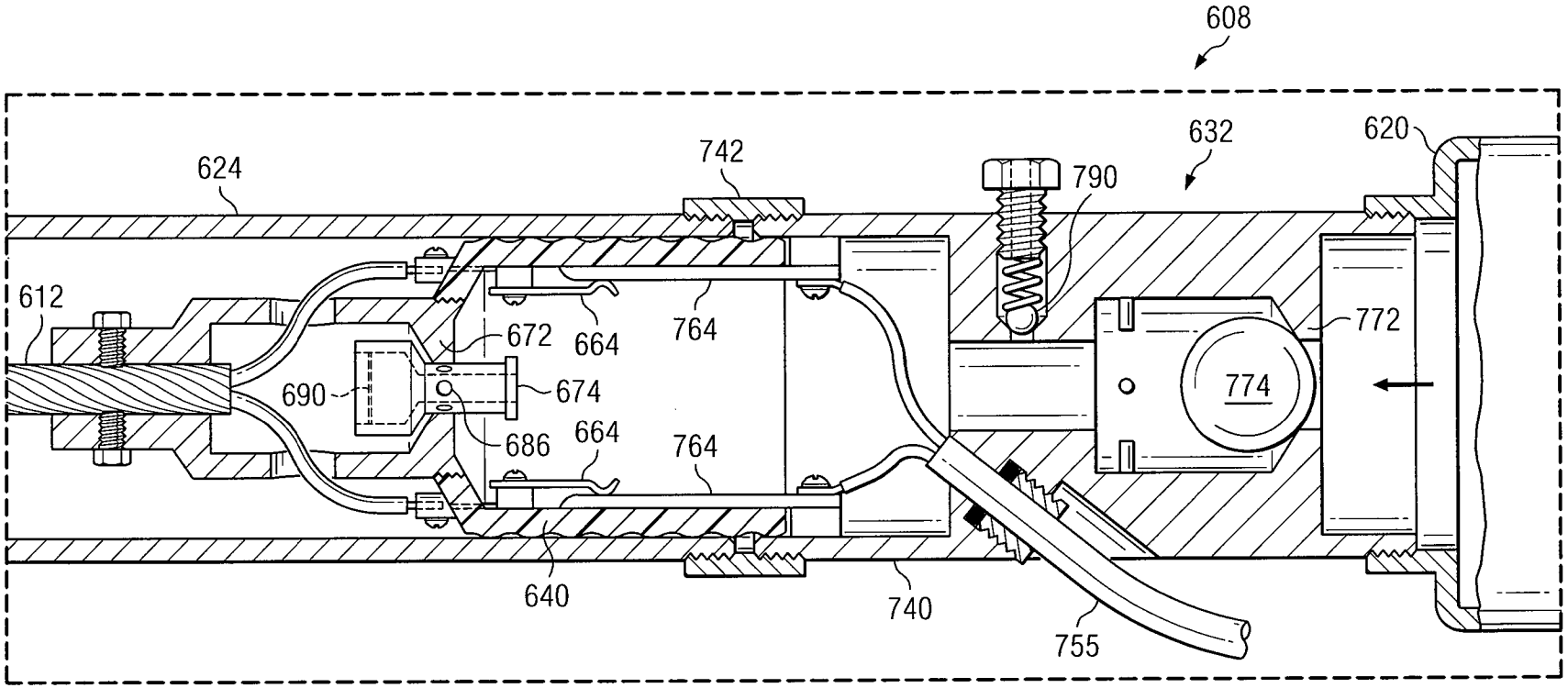
FIG. 6E depicts the plug of FIG. 6B and the receiver of FIG. 6D in an engaged position.

Referring more specifically to FIG. 6D, the receiver 632 is positioned at the downhole location 614 in the well. While the downhole location 614 illustrated in FIG. 6D is located within a horizontal portion of the well 618, the downhole location 614, and thus the location of the pump 620 and receiver 632, may instead be located within a vertical portion of the well 618. The receiver 632 includes a receiver housing 740 that may be positioned between the tubing string 624 and the pump 620. In the embodiment illustrated in FIG. 6D, the receiver 632 is connected to the tubing string 624 by a coupler 742. The receiver 632 may be threadingly connected to the pump 620.

The receiver housing 740 includes a cable passage 754 for receiving an electrical jumper 755 that electrically communicates with pump 620. Similar to cable 612, the jumper 755 is a duplex cable and includes a pair of individually insulated electrical lines 758. The electrical lines 758 are each terminated at a conductor 764.

The receiver 632 includes a passage 768 to permit fluid communication between the tubing string 624 and the pump 620. A valve 770, such as a one-way or check valve, is operably associated with the passage 768 to restrict fluid flow through the passage 768 in a downhole direction and allow fluid flow through the passage 768 in an uphole direction. The valve 770 includes a valve seat 772 and a valve body 774. Fluid flow through the passage 768 is controlled by the valve body 774 moving into or out of contact with the valve seat 772. The valve body 774 may be substantially spherical in shape as illustrated in FIG. 6D, or may be any other shape that permits suitable sealing with a valve seat.

The valve body 774 is capable of moving between an open position (not illustrated) and a closed position (see FIG. 6D). The closed position is achieved by the presence of fluid uphole of the receiver 632 having a pressure higher than that of fluid downhole of the receiver 632. When the pressure of fluid downhole of the receiver 632 exceeds that of the fluid uphole of the receiver 632, the valve body 774 moves to the open position. In the open position, fluid communication between the pump 620 and the tubing string 624 is enabled, thereby providing a path for fluid discharged by the pump 620.

A receiver relief valve 790 is operably associated with the receiver housing 740 to permit fluid communication between the passage 768 and an annulus 769 formed between the tubing string 724 and the well bore 616 when a pressure of fluid within the passage 768 meets or exceeds a set pressure of the receiver relief valve 790. When the pressure of fluid in the passage 768 is less than the set pressure of the receiver relief valve 790, the receiver relief valve 790 will prevent fluid communication between the passage 768 and the annulus 769.

Referring still to FIGS. 6A-6E, in operation, the cable 612 is installed by "pumping" the plug 628 and cable 612 down the tubing string 624. More specifically, pressurized fluid is introduced by a pump 795 behind or uphole of the plug housing 640 to push the plug housing 640 down the tubing string 624. Providing this force to the plug 628 is necessary when the plug 628 must navigate portions of the well 618 that are not vertical. The cable 612 may be supplied to the well 618 by a spool 665 and pulley system 667 positioned at a surface of the well 618 (see FIG. 6A).

Prior to pumping the plug 628 down the well 618, the tubing string 624 may be filled with fluid to control the descent of the plug 628 and cable 612. The set pressure of the receiver relief valve 790 is high enough to support the weight of a full column of fluid in the tubing string 624 extending from the surface of the well 618 to the receiver 632, combined with the dead weight of the cable pushing against the plug 628.

After filling the tubing string 624 with fluid, the plug 628 may be inserted into the tubing string 624 at the surface of the well 618 and fluid pressure applied behind the plug 628 to pump down the plug 628. Exerting fluid pressure behind or uphole of the plug increases the pressure of the fluid between the plug and the receiver, thereby exceeding the set point of the receiver relief valve 790 and opening the receiver relief valve 790. With the receiver relief valve 790 open, the fluid between the plug 628 and the receiver 632 drains from the tubing string 624 into the annulus 769. Preferably, the fluid in the tubing string is incompressible, such as for example water, and the release of this incompressible fluid through the receiver relief valve 790 permits a controlled descent of the plug 628 to the receiver 632.

When the plug 628 reaches the downhole location 614 and the receiver 632, the accumulated fluid in the tubing string 624 uphole of the plug 628 (i.e. the fluid that has been pumped into the tubing string behind the plug 628 by pump 795) pushes the plug 628 into engagement with the receiver 632. The engagement between the plug 628 and receiver 632 causes the conductors 664 to mate with the conductors 764. A detachable locking mechanism may be employed to maintain engagement during operation of the pump. Contact between the conductors 664, 764 permits electrical communication, thereby linking the cable 612 to the pump 620. Following delivery of the cable 612, the cable 612 may be connected to an electrical power source (not shown) at the surface of the well 618 to power the pump 620.

When the pump is operating, discharge fluid from the pump 620 causes the valve body 774 and the valve body 674 to move to the open position, which permits the discharge fluid to travel through passage 768, passage 668, and the tubing string 624 to the surface of the well 618. When the pump 620 is shut down, any accumulated fluid in the tubing string 624 above the plug 628 and receiver 632 is prevented from moving back down the well by the valve body 674, which moves to the closed position.

In deep wells, it may be difficult if not impossible to disengage the plug 628 from the receiver 632 by simply pulling on the cable. If the column of fluid above the plug 628 exerts a sufficient force on the plug 628, this force may exceed the strength of the cable. In these cases, prior to disengagement of the receiver 632 and plug 628, the fluid uphole of the plug may be drained from the tubing string. In one embodiment, a fluid such as water is pumped into the tubing string 624 so as to cause the rupture disk 690 to fail and allow fluid trapped above the plug 628 to flow through the plug as the cable 612 and plug 628 are pulled form the well 618. In another embodiment, a low density fluid such as air is pumped into the tubing, displacing the higher density fluid trapped above the plug through the relief device 690 and the receiver relief valve 790.

While the embodiments illustrated in FIGS. 6A-6E are directed primarily to delivery of an electric power cable to an electric submersible pump, the system and methods of cable delivery described herein may be applied to power cables, data transmission cables, fiber optic cables, or any other type of cable that is needed in a well. In the event that fiber optic cables are used, the conductors provided with the plug and receiver may be replaced with suitable components for competing on optical splice. Similarly, the downhole device to which the cable is delivered is not limited solely to electric submersible pumps. Other devices may include wireline logging equipment, sensor arrays, drill motors, or any other device that is in need of power or data transmission in a downhole environment.

Figure 7:
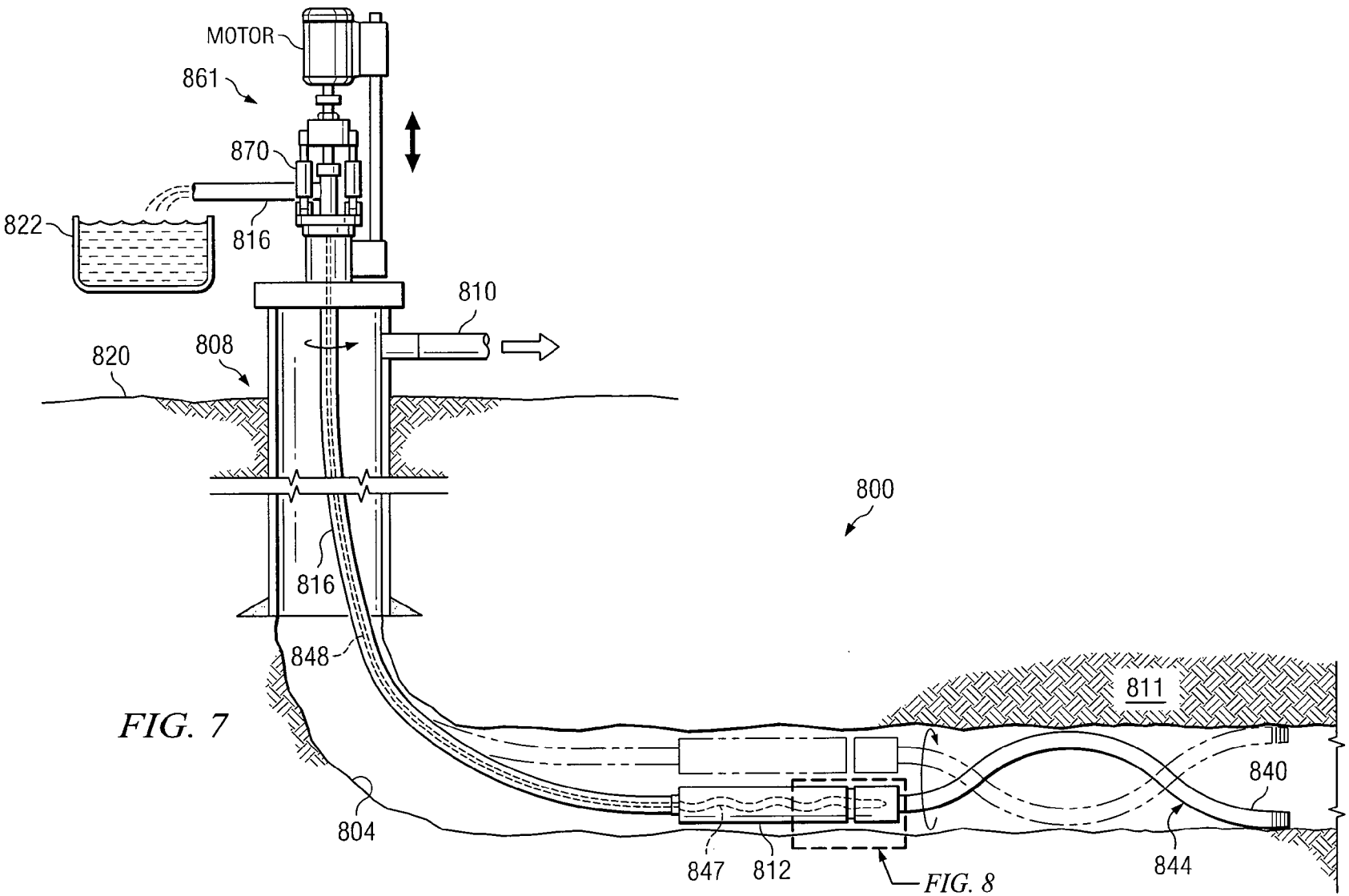
FIG. 7 illustrates a system for controlling solids in a wellbore of a well according to another illustrative embodiment, the system having a progressing cavity pump with a rotor configured to selectively rotate an offset portion of a tubing string.
Figure 8:
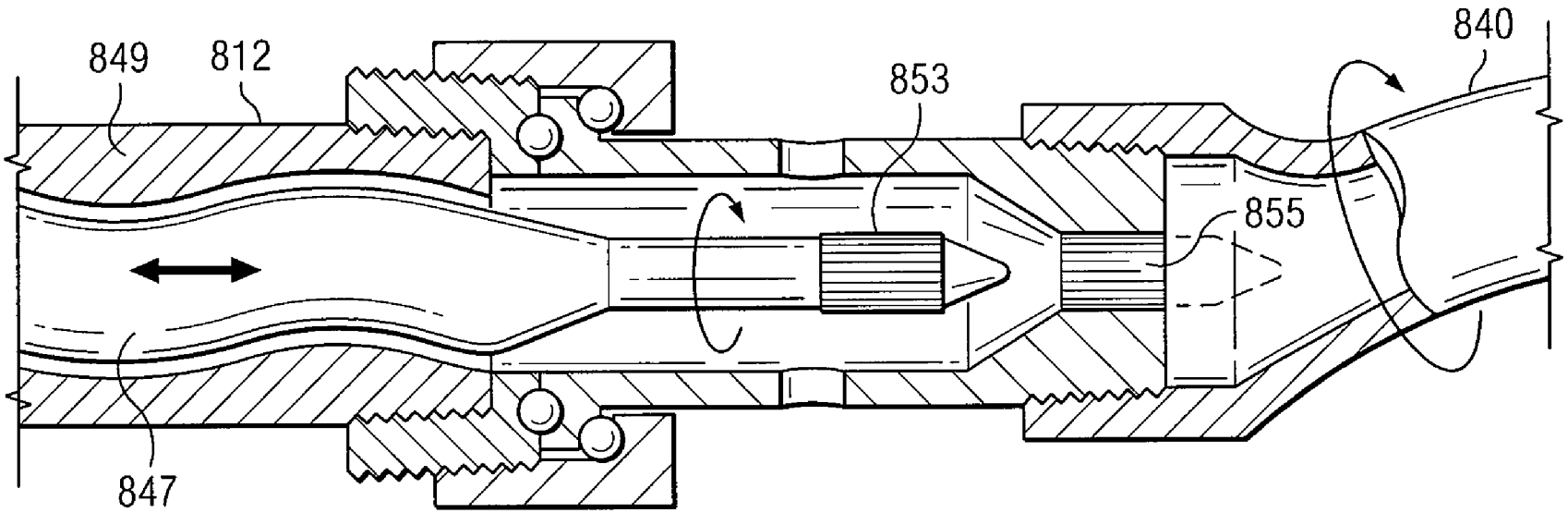
FIG. 8 depicts a detailed view of the progressing cavity pump and the tubing string of FIG. 8.

Referring to FIGS. 7 and 8, a system 800 for controlling solids within a wellbore 804 of a well 808 according to an illustrative embodiment includes a pump 812 positioned downhole. A first tubing string 816 extends from a surface 820 of the well 808 and is operatively connected to the pump 812. A second tubing string 840 is operatively connected to the pump 812 and includes an offset portion 844 similar to those offset portions described previously.

Pump 812 is a progressing cavity pump that includes a rotor 847 that is capable of rotating within a stator 849 to remove liquid from the wellbore 804. Energy to rotate the offset portion 844 of the second tubing string 840 is provided by the rotor 847, which is operatively connected to a drive motor at the surface 820 via the first tubing string 816. The rotor 847 is axially movable between a disengaged position (shown in FIG. 8) and an engaged position. In the embodiment illustrated in FIG. 8, the rotor 847 is operatively associated with a drive shaft 853 that axially moves with the rotor 847. When the rotor 847 is placed into the engaged position, the drive shaft 853 is received by a receiver 855 that is operatively associated with the second tubing string 840. The drive shaft 853 and the receiver 855 are matingly keyed or include matching splines or other features to allow transmission of rotational movement from one of the drive shaft 853 and the receiver 855 to the other when the drive shaft 853 is received by the receiver 855. While the drive shaft 853 is illustrated in FIG. 8 as being operatively associated with the rotor 847 and the receiver 855 with the second tubing string 840, in another embodiment, the receiver 855 may be operatively associated with the rotor 847 and the drive shaft 853 with the second tubing string 840.

Selective engagement of the drive shaft 853 and receiver 855, and thus selective rotation of the second tubing string 840 is provided by a hydraulic lift 861 positioned at the surface 820 and configured to move the rotor 847 between the engaged position and disengaged position. When agitation of the second tubing string 840 is desired, the hydraulic lift 861 lowers the first tubing string 816, which moves the rotor 847 from the disengaged position to the engaged position. Rotation of the rotor 847 is then transmitted through the drive shaft 853 and receiver 855 to the second tubing string 840 to agitate solids within the wellbore 804. Upon completion of the agitation cycle, the hydraulic lift 861 is lifted, disengaging the drive shaft 853 from the receiver 855 and allowing normal operation of the progressing cavity pump 812. For the agitation portion of the pump cycle, low speed rotation of between 5% to 50% of the normal operating speed of the progressing cavity pump 812 may be employed. Another embodiment envisions continuous agitation of the second tubing string 840, rather than a selective engagement. If necessary, single or multiple planetary gear reduction units may be positioned between the rotor 847 and the second tubing string 840 to further reduce rotational speed and increase torque, as may be desirable for either selective or continuous pump and tubing agitation.

It should be apparent from the foregoing that an invention having significant advantages has been provided. While the invention is shown in only a few of its forms, it is not just limited but is susceptible to various changes and modifications without departing from the spirit thereof.

I claim:

1. A cable delivery system for providing power to a downhole location in a well, the system comprising:

a pump positioned in the well;

a tubing string in fluid communication with the pump to receive liquid discharged from the pump;

an electrical cable configured for communication with an electrical power source;

a plug having at least one conductor in electrical communication with the electrical cable, the plug having a plug housing adapted to fit within the tubing string, the plug housing having a passage to permit fluid flow past the plug housing;

a check valve operably associated with the passage of the plug housing to restrict fluid flow through the passage in a downhole direction and allow fluid flow through the passage in an uphole direction; and a receiver positioned at the downhole location, the receiver having a receiver housing and at least one conductor in electrical communication with the pump, the at least one conductor of the receiver adapted to electrically communicate with the at least one conductor of the plug when the receiver housing and the plug housing are engaged, the receiver housing having a passage in fluid communication with the tubing string and the pump.

2. The system according to claim 1, wherein the downhole location is within a horizontal portion of the well.

3. The system according to claim 1, wherein the plug and cable are pushed to the downhole location by a pressurized fluid introduced uphole of the plug.

4. The system according to claim 1 further comprising:

a relief valve operably associated with the receiver to control the descent of the plug as the plug is lowered into the well through the tubing string.

5. The system according to claim 1 further comprising:

a braking system positioned at a surface of the well to control advancement of the electrical cable into the tubing string as the plug is lowered into the tubing string.

6. The system according to claim 1 further comprising:

a pressure relief device operably associated with at least one of the check valve and the plug housing to allow fluid flow past the plug housing when a pressure of fluid in the tubing string uphole of the plug exceeds a set pressure of the pressure relief device.

7. The system according to claim 6, wherein the pressure relief device is a rupture disk.

8. The system according to claim 1 further comprising:

a second check valve operably associated with the passage of the receiver housing to restrict fluid flow through the passage in a downhole direction and allow fluid flow through the passage in an uphole direction; and a receiver relief valve operably associated with one of the receiver housing and the tubing string and capable of allowing fluid communication between the tubing string and an annulus formed between the tubing string and the well bore.

9. The system according to claim 8, wherein:

when the receiver housing and plug housing are engaged, fluid pumped by the pump may be routed past the second and first check valves and through the tubing string to a surface of the well.

10. The system according to claim 1 further comprising:

a pressure relief device operably associated with at least one of the check valve and the plug housing to allow fluid flow past the plug housing when a pressure of fluid in the tubing string uphole of the plug exceeds a set pressure of the pressure relief device;

a second check valve operably associated with the passage of the receiver housing to restrict fluid flow through the passage in a downhole direction and allow fluid flow through the passage in an uphole direction; and a receiver relief valve operably associated with one of the receiver housing and the tubing string and capable of allowing fluid communication between the tubing string and an annulus formed between the tubing string and the well bore.

11. The system according to claim 10, wherein the receiver relief valve is positioned uphole of the second check valve and is capable of allowing fluid communication between the passage of the receiver housing and the annulus when a pressure of fluid within the passage of the receiver housing meets or exceeds a set pressure of the receiver relief valve.

12. The system according to claim 10 further comprising:

a compressed gas source in communication with the tubing string such that compressed gas can be injected into the tubing string to facilitate disengagement of the plug from the receiver.

13. The system according to claim 10, wherein:

prior to the plug being introduced into the tubing string at a surface of the well, a fluid is introduced into the tubing string to control the descent of the plug as the plug is lowered into the well through the tubing string;

the plug and cable are pushed to the downhole location by pressurized fluid introduced uphole of the plug;

as the plug is pushed toward the downhole location, the fluid downhole of the plug exceeds the set pressure of the receiver relief valve and exits the receiver relief valve into the annulus;

when the receiver housing and plug housing are engaged, fluid pumped by the pump is capable of being routed past the second and first check valves and through the tubing string to a surface of the well; and prior to disengagement of the receiver housing and plug housing, fluid pressure in the tubing string uphole of the plug is increased to exceed the set pressure of the pressure relief device and the set pressure of the receiver relief valve, thereby allowing the fluid in the tubing string to be pushed into the annulus.

14. A system for delivering a cable through a tubing string to a downhole location in a well, the system comprising:

a plug having a first connector configured to be operably connected to the cable, the plug having a plug housing adapted to fit within the tubing string, the plug housing having a passage to permit fluid flow past the plug housing;

a check valve operably associated with the passage of the plug housing to restrict fluid flow through the passage in a downhole direction and allow fluid flow through the passage in an uphole direction; and a receiver configured to be positioned at the downhole location, the receiver having a receiver housing and a second connector configured to be operably connected to a downhole device, the second connector of the receiver adapted to communicate with the first connector of the plug when the receiver housing and the plug housing are engaged.

15. The system according to claim 14, wherein the receiver housing includes a passage allowing fluid communication between the tubing string and a location downhole of the receiver housing.

16. The system according to claim 14, wherein the downhole device is an electrically powered pump and the cable is an electric cable to provide power to the pump.

17. The system according to claim 14, wherein the downhole device is a wireline logging unit.

18. The system according to claim 14, wherein:

the cable is a fiber optic cable; and the first connector and second connector when joined form a splice for the fiber optic cable.

19. The system according to claim 14, wherein the cable is a data transmission cable.

20. The system according to claim 14, wherein the downhole location is within a horizontal portion of the well.

21. The system according to claim 14 further comprising:

a braking system positioned at a surface of the well to control advancement of the cable and plug into the tubing string as the plug is lowered into the tubing string.

22. The system according to claim 14 further comprising:

a pressure relief device operably associated with at least one of the check valve and the plug housing to allow fluid flow past the plug housing when a pressure of fluid in the tubing string uphole of the plug exceeds a set pressure of the pressure relief device.

23. The system according to claim 22, wherein the pressure relief device is a rupture disk.

24. The system according to claim 15 further comprising:

a second check valve operably associated with the passage of the receiver housing to restrict fluid flow through the passage in a downhole direction and allow fluid flow through the passage in an uphole direction; and a receiver relief valve operably associated with one of the receiver housing and the tubing string and capable of allowing fluid communication between the tubing string and an annulus formed between the tubing string and the well bore.

25. The system according to claim 15 further comprising:

a pressure relief device operably associated with at least one of the check valve and the plug housing to allow fluid flow past the plug housing when a pressure of fluid in the tubing string uphole of the plug exceeds a set pressure of the pressure relief device;

a second check valve operably associated with the passage of the receiver housing to restrict fluid flow through the passage in a downhole direction and allow fluid flow through the passage in an uphole direction; and a receiver relief valve operably associated with one of the receiver housing and the tubing string and capable of allowing fluid communication between the tubing string and an annulus formed between the tubing string and the well bore.

26. A method for delivering a cable through a tubing string to a downhole location in a well:

providing a receiver at the downhole location, the receiver having a conductor in communication with a downhole device;

positioning a plug in the tubing string, the plug having a conductor and being connected to the cable such that the conductor is in communication with the cable;

delivering the plug to the downhole location by pumping fluid into the tubing string uphole of the plug;

prior to delivering the plug, introducing fluid into the tubing string downhole of the plug;

engaging the plug and the receiver such that the conductor of the plug communicates with the conductor of the receiver; and delivering power from a surface of the well to the downhole device through the cable.

27. The method according to claim 26, wherein delivering the plug to the downhole location further comprises:

removing fluid in the tubing string between the plug and the receiver through a relief valve positioned downhole in communication with the tubing string.

28. The method according to claim 26, wherein delivering the plug to the downhole location further comprises:

substantially restricting fluid pumped into the tubing string uphole of the plug from flowing past the plug.

29. The method according to claim 26, wherein the downhole device is a pump.

30. The method according to claim 29 further comprising:

allowing fluid pumped by the pump to flow past the receiver and plug and through the tubing string to the surface of the well.

31. The method according to claim 26 further comprising:

prior to the plug being disengaged from the receiver, increasing the pressure of fluid in the tubing string uphole of the plug such that the fluid is exhausted from the tubing string through a relief valve associated with at least one of the plug and the receiver.

* * * * *